United States Patent [19]

Nelson

[11] 3,985,161

[45] Oct. 12, 1976

[54] SPRAY MACHINE

[75] Inventor: Thomas L. Nelson, Doraville, Ga.

[73] Assignee: Southern Oxygen Supply Company, Atlanta, Ga.

[22] Filed: Dec. 6, 1974

[21] Appl. No.: 530,362

[52] U.S. Cl. ..... 239/185; 118/323; 239/186

[51] Int. Cl.[2] ..... B05B 3/18

[58] Field of Search ..... 239/184, 185, 186; 105/154, 155; 104/119, 94, 120; 118/321, 323

[56] References Cited

UNITED STATES PATENTS

| | | | |
|---|---|---|---|
| 2,488,519 | 11/1949 | Andrews et al. | 118/323 X |
| 2,668,978 | 2/1954 | DeMart | 239/185 X |
| 2,710,225 | 6/1955 | Richards | 239/186 |
| 2,728,238 | 12/1955 | Paasche | 239/186 |
| 3,266,729 | 8/1966 | Baskett | 239/186 |
| 3,648,617 | 3/1972 | Metzner et al. | 104/119 X |

*Primary Examiner*—John J. Love
*Assistant Examiner*—Michael Mar
*Attorney, Agent, or Firm*—Robert B. Kennedy

[57] ABSTRACT

A spray machine comprising a track and a carriage movably supported on the track carrying a cam actuator and a fluid spray gun. An air cylinder is mounted above the track having a piston slidably disposed therein with opposite piston ends coupled with the carriage. A pair of air lines are connected to opposite ends of the cylinder and to a source of compressed air through a valve controlling the flow of air delivered to the air cylinder. A valve actuator is mounted adjacent opposite ends of the track for activating the valve upon engagement with the cam actuator as the carriage approaches the track ends.

3 Claims, 3 Drawing Figures

SPRAY MACHINE

BACKGROUND OF THE INVENTION

This invention relates generally to spray machines, and particularly to spray machines of the type adapted to reciprocally traverse sheets and webs of material being continuously fed thereby.

Heretofore, machines used in spraying relatively wide, continuous webs or sheets of materials have generally been of either a fixed spray or movable spray type. With a fixed spray machine more than a single spray gun or nozzle must ordinarily be used to achieve lateral uniformity of the applied coating. Thus, the material to be coated is ordinarily fed at a constant velocity beneath a set of laterally spaced spray guns with each gun coating one longitudinal segment of the material. These types of machines have the advantage of minimizing the use of movable parts since there is not need for motors, transmission systems, spray gun tracks or guides.

A principal problem associated with the fixed type of spray machines arises from the tendency of the spray gun nozzles to become partially restricted or even completely clogged with coating fluid. When this occurs the spray gun having a restricted or clogged nozzle commences to apply a thinner or lighter coat to that segment of the material being passed adjacent that particular gun or nozzle. This may result in an easily recognized and noticeable unevenness of coating. In addition, with this type of machine it is difficult simultaneously to prevent both overlapping and lateral spacings between longitudinal coating segments from arising.

To overcome the just mentioned problem characteristic of fixed spray type machines, other machines have been devised having but a single spray gun mounted for reciprocal movement above material to be coated which material is moved therebeneath at a constant rate of speed. Such spray guns either employ a pair of closely spaced nozzles coupled with a manifold, or but a single nozzle. Should one member of the pair of nozzles become restricted the resulting deficiency in applied coating is not readily noticeable since the spray pattern of each nozzle overlaps the other. Even should the movable spray gun employing but a single nozzle become partially restricted the result may not be noticeable since the reduction in coating thickness exists uniformly over the entire width of the coated surface.

Though spray machines employing a traversing spray gun have the very decided advantage just mentioned, they do require moving parts as well as equipment for continuously moving the spray gun. To drive the guns along such a reciprocating path machines have been developed with chains coupled to gear motors and the like for driving a spray gun supporting carriage along a track extending above the material to be coated. These systems have proven relatively bulky and unreliable in operation due to the precision of movement required of the spray gun coupled with the synchronous actuation and deactuation of the gun during acceleration and deacceleration operation which is necessary to prevent excessive coating from occurring while the gun is moving at reduced rates of speed over the side portions of the material. Furthermore, such spray guns have lacked stability since their reciprocal movements have often created moments of inertia causing the gun to wobble as its direction of movement is reversed.

Accordingly, it is a general object of the present invention to provide an improved spray machine.

More specifically, it is an object of the present invention to provide an improved spray machine of the type which includes a spray gun mounted for reciprocal movement along a track beneath or beside which sheets of material are continuously passed for spraying.

Other objects of the invention are to provide a spray machine of the type just described which is relatively stable, inexpensive, reliable in operation and requiring minimal ancillary power supply means.

SUMMARY OF THE INVENTION

In one form of the invention a spray machine is provided comprising a frame, a first pair of rails supported one above the other by the frame, and a second pair of rails supported one above the other by the frame laterally spaced aside the first pair of rails. The machine has a carriage supporting a spray gun with at least one wheel in rotatable engagement with each of the rails. The machine further includes means for reciprocally driving the carriage and spray gun along the rails.

In another form of the invention a spray machine is provided comprising a track and a carriage movably supported on the track carrying cam actuating means and fluid spray means. An air cylinder is mounted above the track having a piston slidably disposed therein with opposite piston ends coupled with the carriage. A pair of air lines are connected to opposite ends of the cylinder and to a source of compressed air through valve means for controlling the flow of air delivered to the air cylinder. The machine further includes valve actuating means mounted adjacent opposite ends of the track for actuating the valve means upon engagement with the cam actuating means as the carriage approaches the track ends.

In yet another form of the invention a spray machine is provided comprising upper and lower tracks and a carriage movably supported on the tracks. Means are provided for reciprocally driving the carriage along the tracks. A spray gun is supported on the carriage beneath the lower track. Control means are provided for turning on and off the spray gun as it departs and approaches end portions of the track.

DETAILED DESCRIPTION OF THE DRAWING

Figure 1:
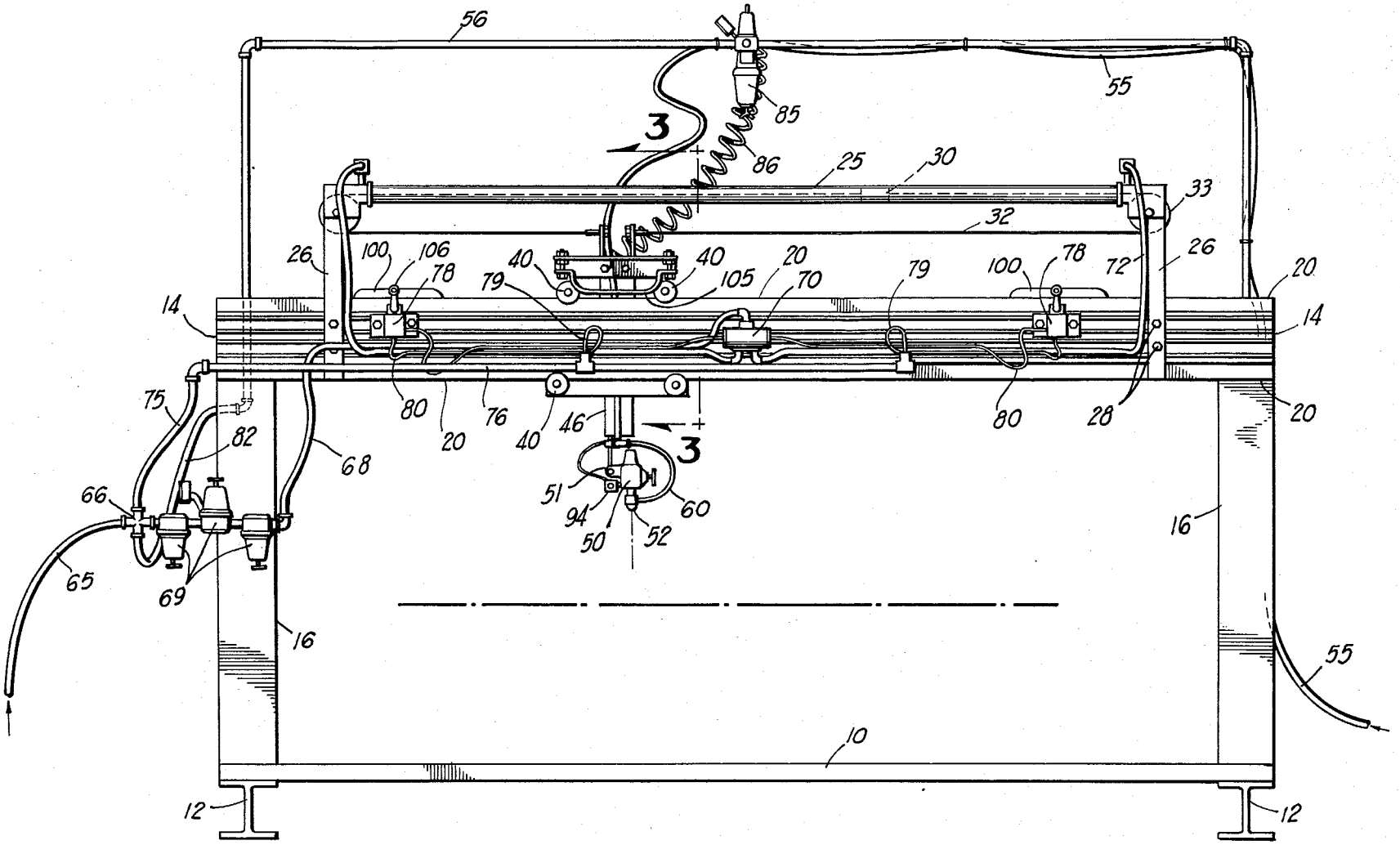
FIG. 1 is a front view in elevation of a spray machine embodying principles of the present invention in a preferred form.
Figure 2:
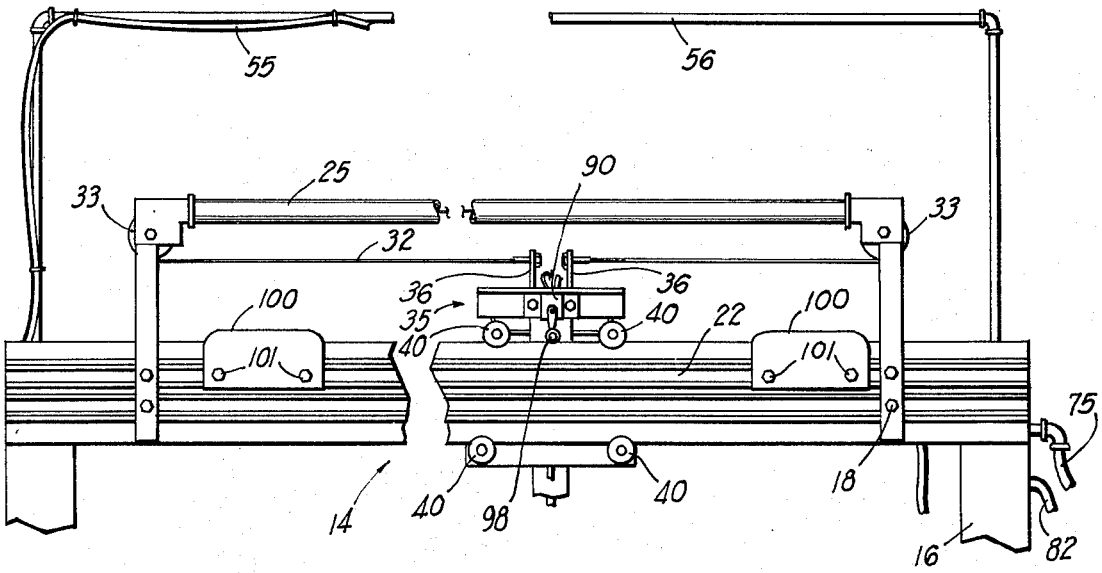
FIG. 2 is a rear view of a portion of the spray machine shown in FIG. 1.
Figure 3:
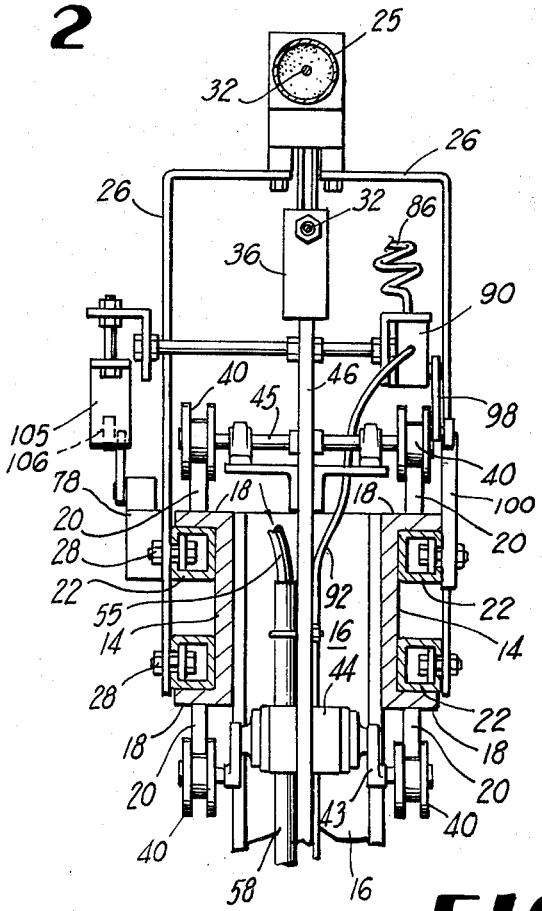
FIG. 3 is a side view in cross-section of a portion of the machine shown in FIGS. 1 and 2 taken along plane 3—3.

Referring now in more detail to the drawing, there is shown a spray machine having a frame which includes a substantially flat floor 10 raised above machine supporting terrain by a pair of I-beam feet 12. A pair of mutually spaced, back to back, U-shaped beams 14 are supported above frame floor 10 by a pair of I-beam post 16 mounted to each end of floor 10. The upper and lower surfaces 18 of beams 14 each lie along a common, substantial horizontal plane and support a rail 20 whereby the wheel support surface of the upper rails is atop the rail while the wheel support surface of the lower rail is along the bottom thereof. A pair of C-shaped channel members 22 are rigidly secured to the outsides of U-shape beams 14.

An air cylinder 25 is mounted above the upper track provided by the two rails 20 mounted to the top surfaces 18 of beams 14 by a pair of angle irons 26 and bolt, washer and nut assemblies 28. This is accomplished by placing the bolt heads and washers within the bounds of the C-shaped channel members 22 with the threaded portion of the bolts extending through holes in angle irons 26 and then running the nuts up the bolts tightly against the outer surfaces of the angle irons. The air cylinder itself has a piston 30 slidable disposed therein. Two cables 32 extend from each end of the piston through the main body of the cylinder, out cylinder ends through centrally apertured gaskets, over pulleys 33, to posts 36 atop a carriage 35 movably supported upon the upper and lower tracks provided by rails 18. Alternatively, a single cable may be used running continuously between opposite sides of piston 30 through fastening means atop the carriage.

Carriage 35 is further seen to include eight wheels 40 with a pair of wheels being rotatably disposed upon each of the four fails 20. The four lower wheels 40 are rotatably mounted upon the outboard ends of adjustable arms 43 pivotably secured to block 44. The pivotal mounting of the arms of the block serves to facilitate mounting and dismounting of the carriage as a whole to the upper and lower tracks. During machine operation conventional set screws are employed to prevent pivotable movement of the arms.

Block 44, as well as rod 45 to which the upper set of four wheels 40 are rotatably mounted, are both rigidly connected to an upright, central support member 46 of the carriage which extends both above and below the tracks. A spray gun 50 is mounted beneath support member 46 by a bracket 51 with the single spray gun nozzle 52 aimed downwardly. Spray fluid is supplied to the spray gun nozzle from an unshown tank by means of a flexible conduit 55 which is draped along a support rod 56 mounted above the tracks and the air cylinder. The flexible conduit 55 passes from the support rod down to a manifold 58 mounted to the carriage aside upright support member 46. The spray gun 50 is coupled with the manifold through flexible conduit 60.

The reciprocally drive carriage 35 along the upper and lower tracks compressed air is directed to the machine from an unshown supply tank through a conduit 65. This line is divided at a cross-fitting 66 into three lines one of which connects to a flexible line 68 through a series of three pressure regulators, filters and lubricators 69. Flexible line 68 is connected to a spool valve 70 mounted aside a beam 14. Two flexible lines 72 couple the spool valve to opposite ends of air cylinder 25 adjacent unshown quick relief valves mounted to the cylinder ends above pulleys 33. From cross-fitting 66 extends another air line 75 to a manifold 76 from which communicate, by means of flexible lines 79, two limit valves 78 mounted to an upper C-shape channel 22. Limit valves 78 are in turn connected to spool valve 70 through flexible lines 80. The third air line 82 extends from cross-fitting 66 to rod 56, which is hollow, which in turn communicates with air regulator 85. From the air regulator extends a coil 86 downwardly to a limit valve 90 mounted to the carriage. Another air line 92 extends from valve 90 down to spray gun 50 adjacent a dump valve 94.

In operation, compressed air is fed through spool valve 70 to one end of air cylinder 25 causing piston 30 to be propelled towards the other end of the cylinder where air is exhausted through the quick relief valve located at that end. As the piston is so driven carriage 35 is moved in the opposite direction by means of cables 32 coupled with the piston. As the carriage approaches the track end actuation arm 98 of valve 90 mounted to the carriage engages a fixed cam 100 mounted adjacent an end of the track by means of bolts 101 to an upper C-shape channel member 22. While located above cam 100 valve 90 terminates the flow of air to spray gun 50. With the flow of air so terminated spray fluid ceases to be drawn by venturi action out of the spray gun nozzle 52. Continued movement of the carriage brings an arcuate cam 105 rigidly mounted to the carriage into engagement with rocker arm 106 actuating a limit valve 78.

Actuation of valve 78 serves to reverse spool valve 70 causing the flow of compressed air through lines 65 and 68 to be directed to the opposite end of the air cylinder. This serves to deaccelerate the piston and then to accelerate it back in the reverse direction. As this is done and the carriage departs the track end, actuation arm 98 descends from cam 100 to operate valve 90 recommencing the flow of compressed air to the spray gun to start its operation. This process is repeated at the opposite end of the track to complete one cycle of operation.

We thus see that a spray machine of the type employing a traversing or reciprocating spray gun is provided which may be operated solely by compressed air. Inasmuch as compressed air is ordinarily required to operate the spray gun itself it is a relatively simple matter to utilize this same source of power for driving and controlling the machine itself. Thus, the compressed air entering the machine through line 65 serves both to operate and control spray gun operation as well as to drive and control its movements. The unique arrangement of carriage and track is seen to enhance stability since the gun, and the carriage from which it is suspended, are both mounted along the center line passing between the tracks eleviating any tendency for the carriage or the spray gun to wobble. Reversals of directions of travel are accomplished with smooth deacceleration and reacceleration. The use of gear motors, chains and sprockets, and indeed the very use of electrical power itself may be completely avoided.

It should be understood that the just described embodiment merely illustrates principles of the invention in one preferred form. Many modifications, additions and deletions may, of course, be made to this specifically illustrated machine without departure from the spirit and scope of the invention as set forth in the following claims.

What is claimed is:

1. A spray machine comprising a frame having a pair of laterally spaced beams; a first pair of rails mounted to and supported one above the other by one of said frame beams; a second pair of rails mounted to and supported one above the other by another of said frame beams; a carriage movably supported between said first and second pairs of rails and having at least one wheel in rotatable engagement with each of said rails; a spray gun supported by said carriage; means for reciprocally driving said carriage along said rails; a channel secured to at least one of said beams; and actuator means mounted to said channel adjacent opposite ends of said first and second pairs of rails for controlling said carriage driving means.

2. A spray machine comprising a track; a carriage movably supported on said track; cam actuating means and fluid spray means mounted to said carriage; an air cylinder having a piston slidably disposed therein with opposite piston ends coupled with said carriage and a pair of quick relief valves mounted adjacent said opposite end portions; a pair of air lines connected to opposite end portions of said cylinder; valve means connected to said pair of air lines for controlling the flow of air delivered to said air cylinder; and valve actuating means mounted adjacent opposite ends of said track for actuating said valve means upon engagement with said cam actuating means as said carriage approaches the track ends.

3. A spray machine comprising upper and lower tracks with each of said tracks comprising a pair of horizontally spaced rails; a carriage movably positioned on said tracks; means for reciprocally driving said carriage along said tracks including an air cylinder mounted above said upper track between said upper track pair of rails and with said air cylinder having a piston movably disposed therein with opposite piston ends coupled with said carriage; a valve for directing air to opposite ends of said air cylinder and valve actuation means mounted adjacent opposite end portions of at least one of said tracks; a spray gun supported on said carriage beneath said lower track; and control means for turning on and off said spray gun as it departs and approaches end portions of said track, respectively.

* * * * *